US005269241A

United States Patent [19]

Cartabbia

[11] Patent Number: 5,269,241

[45] Date of Patent: Dec. 14, 1993

[54] INDUSTRIAL SEWING MACHINE FOR SIMULTANEOUSLY MAKING DIFFERENT SEAMING PATTERNS

[76] Inventor: Giovanni Cartabbia, Via Piantada, 9 D, 25036 Palazzolo sull'Oglio (Brescia), Italy

[21] Appl. No.: 871,035

[22] Filed: Apr. 20, 1992

Related U.S. Application Data

[63] Continuation-in-part of Ser. No. 686,675, Apr. 17, 1991, abandoned, which is a continuation-in-part of Ser. No. 607,862, Nov. 1, 1990, abandoned, which is a continuation of Ser. No. 384,274, Jul. 24, 1989, abandoned.

[30] Foreign Application Priority Data

Jul. 26, 1988 [IT] Italy ..... 21494 A/88
Dec. 28, 1990 [IT] Italy ..... 22571 A/90

[51] Int. Cl.[5] ..... B05B 1/08; B05B 25/00

[52] U.S. Cl. ..... 112/163; 112/155; 112/221; 112/311

[58] Field of Search ..... 112/2, 162, 163, 164, 112/165, 166, 167, 168, 220, 221, 311, 312, 155

[56] References Cited

U.S. PATENT DOCUMENTS 993,452 5/1911 Lohman ..... 112/312 X
1,279,832 9/1918 Berger ..... 112/312
2,003,672 6/1935 Weis ..... 112/2
2,203,386 6/1940 Hacklander et al. ..... 112/312
2,637,291 5/1953 Wallenberg et al. ..... 112/162
2,720,853 10/1955 Artzt ..... 112/162 X
3,353,510 11/1967 Reeber et al. ..... 112/165 X
3,435,786 4/1969 Rockerath et al. ..... 112/163 X
4,546,716 10/1985 Babson et al. ..... 112/163 X

FOREIGN PATENT DOCUMENTS 688541 9/1979 U.S.S.R. ..... 112/312

*Primary Examiner*—Clifford D. Crowder
*Assistant Examiner*—Paul C. Lewis
*Attorney, Agent, or Firm*—Bucknam and Archer

[57] ABSTRACT

An industrial sewing machine comprises a supporting frame supporting a main driving shaft rotatively driving two driven shafts, on one of the driven shafts being keyed cam members for reciprocally driving in a horizontal plane a horizontal needle bar, as well as grippers for feeding with fabric operating hook elements, the other driven shaft operating a vertically displaceable vertical needle bar arranged downstream of the horizontal needle bar, the spacing of the horizontal and vertical needle bars being so designed that the needles supported thereby can make simultaneously seaming lines.

5 Claims, 8 Drawing Sheets

INDUSTRIAL SEWING MACHINE FOR SIMULTANEOUSLY MAKING DIFFERENT SEAMING PATTERNS

BACKGROUND OF THE INVENTION

This application is a continuation-in-part of U.S. Ser. No. 686,675 filed Apr. 17, 1991 which was a continuation-in-part of U.S. Ser. No. 607,862 filed Nov. 1, 1990, which was a continuation of U.S. Ser. No. 384,274 filed Jul. 24, 1989. Both Ser. Nos. 384,274 and 607,862 have been abandoned. Also Ser. No. 686,675 has been abandoned.

The present invention relates to a sewing machine for industrial use, which has been specifically designed for simultaneously performing a plurality of different seaming lines. It is known that in the garment industry, frequently the need arises for performing several seaming lines which can be, for example, of the overlock or chain stitch type. Also, it is known that the main stitches must frequently be performed on a given portion of the same cloth or garment. For example, for seaming a shirt sleeve, it is necessary to provide an overlock stitch and then this seaming arrangement must be "stopped" by means of a locked or chain stitch.

These different types of stitches, in particular, must be made on different sewing machines, with different working passes, which, in addition to requiring long operating times, frequently provide imperfectly finished products, because of the difficulty of holding the several seaming lines in a properly aligned condition.

SUMMARY OF THE INVENTION

Accordingly, the main object of the present invention is to overcome the above mentioned drawbacks, by providing a sewing machine, for industrial use, which is specifically designed and arranged to perform, in a single pass, two or more seaming lines, either of similar or different type.

Another object of the present invention is to provide an industrial sewing machine adapted to make either horizontal or vertical stitches.

Still another object of the present invention is to provide a sewing machine in which the fabric being sewn can also be fed or transported at different angles.

A further object of the present invention is to provide a sewing machine in which the fabric flaps or portions to be sewn can be oriented in all working orienting directions, independently from the fact that the fabric portions are in a loose condition or in a partially assembled condition.

BRIEF DESCRIPTION OF THE DRAWINGS

Further characteristics and advantages of the industrial use sewing machine according to the present invention will become more apparent from the following detailed description of a preferred embodiment, which is illustrated, by way of illustration but not limitative example, in the figures of the accompanying drawings, where.

DESCRIPTION OF THE PREFERRED EMBODIMENT

Figure 1:
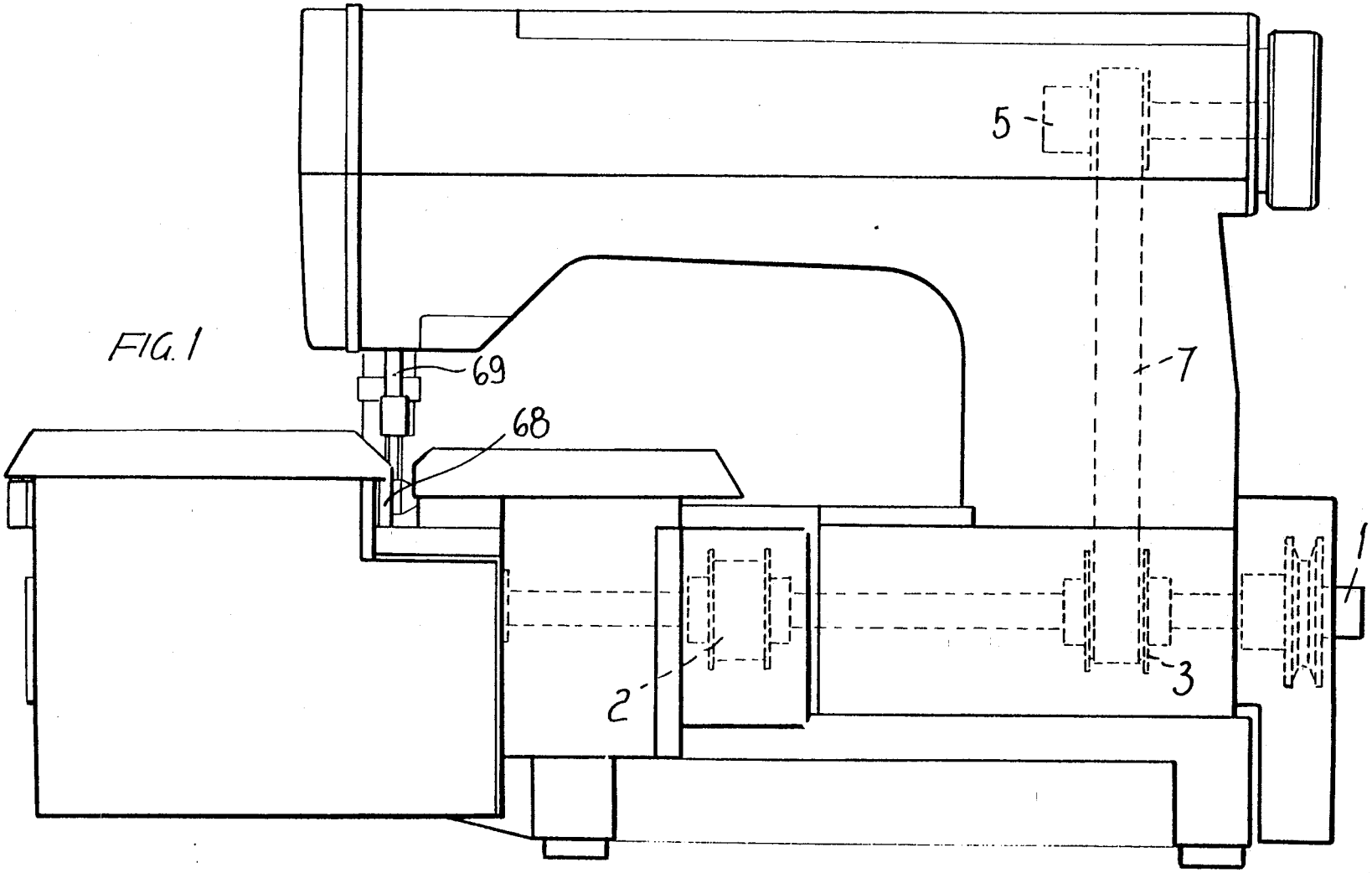
FIGS. 1, 2 and 3 are elevational side and top plan schematic views respectively illustrating the industrial use sewing machine according to the present invention.

With reference to the Figures of the accompanying drawings, the sewing machine for industrial use according to the present invention comprises a supporting frame which has been specifically designed for supporting a main driving shaft 1 which is driven by an electric motor (not shown).

On this main shaft 1 there are keyed two pulleys, indicated respectively at 2 and 3, provided for transmitting a rotary movement to a first and a second driven shafts 4 and 5 through corresponding belts and 7. It should be apparent that the driven shafts 4 and 5 can also be driven by other driving sources, in a timed manner.

The first driven shaft 4 supports a first cam member 8 which, through a connecting rod 9, a ball joint 10 and a swinging pivot sleeve 11, drives a lever 12 provided with a thread tension arm 12' for controlling a horizontal bar 13.

The needle bar 13 is driven in a horizontal plane, and supports, by means of clamp member 14, a respective horizontal needle 15.

Figure 5:
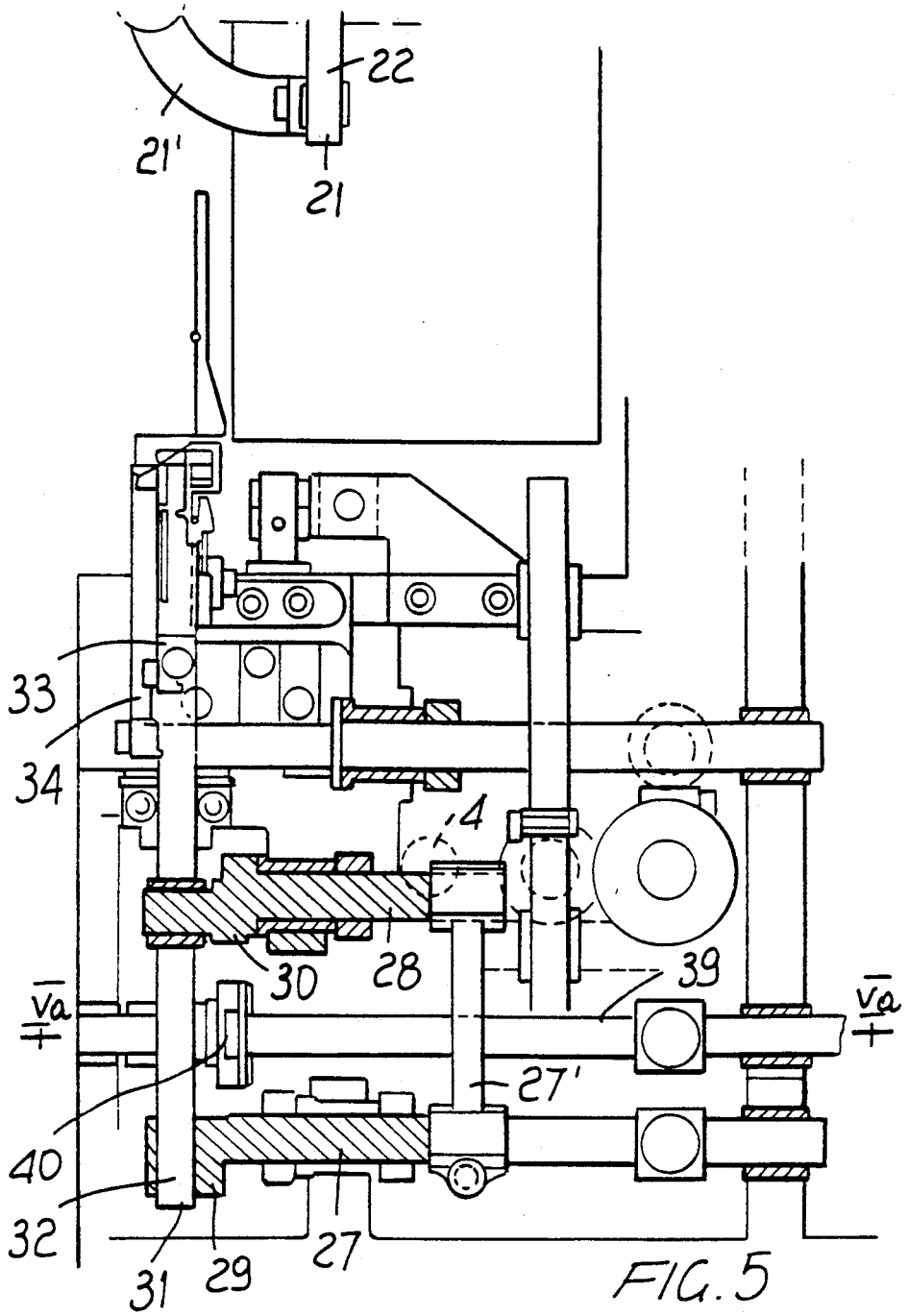
FIG. 5 is a vertical view of the sewing machine in cross-section, taken along the line V—V of FIG. 4.
Figure 5A:
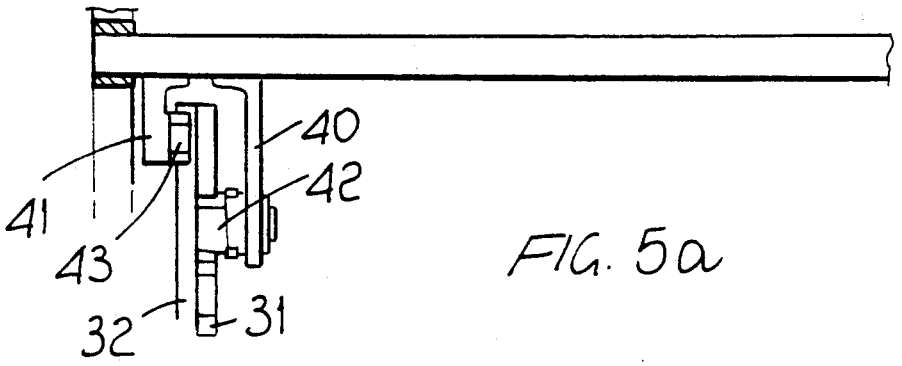
FIG. 5*a* is a vertical view, in cross-section, taken along line Va—Va of FIG. 5.

On the driven shaft 4 there is moreover keyed a second cam member 16 which, through a connecting rod 17, a ball joint 18, a sleeve 19 and a swinging pivot pin 20, drives a trimming knife 21 supported on a knife supporting curved arm 21' which is in turn supported by pin 20 (see FIG. 5).

On the driven shaft 4 there is moreover keyed a third cam member 23 which, through a connecting rod 24, a ball joint 25 and a sleeve 26, drives a first swinging pivot pin 27 which in turn, through a lever 27', drives a second pivot pin 28.

These pivot pins, in particular, support respective eccentric levers 29 and 30 which can raise gripper bearing sliders, respectively indicated at 31 and 32, as shown in FIG. 5.

More specifically, the gripper bearing slide 31 fixedly supports the fabric feeding gripper or clamp 33.

The slider 32, in turn, supports the gripper 34 for driving the fabric beyond the needle.

In this connection it should be pointed out that the gripper 33 can also be called "differential gripper" since it can carry out an operating stroke different from that of the gripper 34 which, in turn, can be called the "stitching gripper".

On the driven shaft 4 there is also mounted a stitch stretching cam member 35 which, through a connecting rod 36, a ball joint 37 and a sleeve 38, can drive a swinging pivot pin 39. This pivot pin drives rotatively the levers 40 and 41 which are respectively provided with driving pins 42 and 43, which, in operation, drive the respective gripper bearing sliders 31 and 32 so as to bring the sliders in contact with the fabric being sewn and cause the sliders to come back, in a lowered condition, under the control of the eccentric levers 29 and 30.

Figure 6:
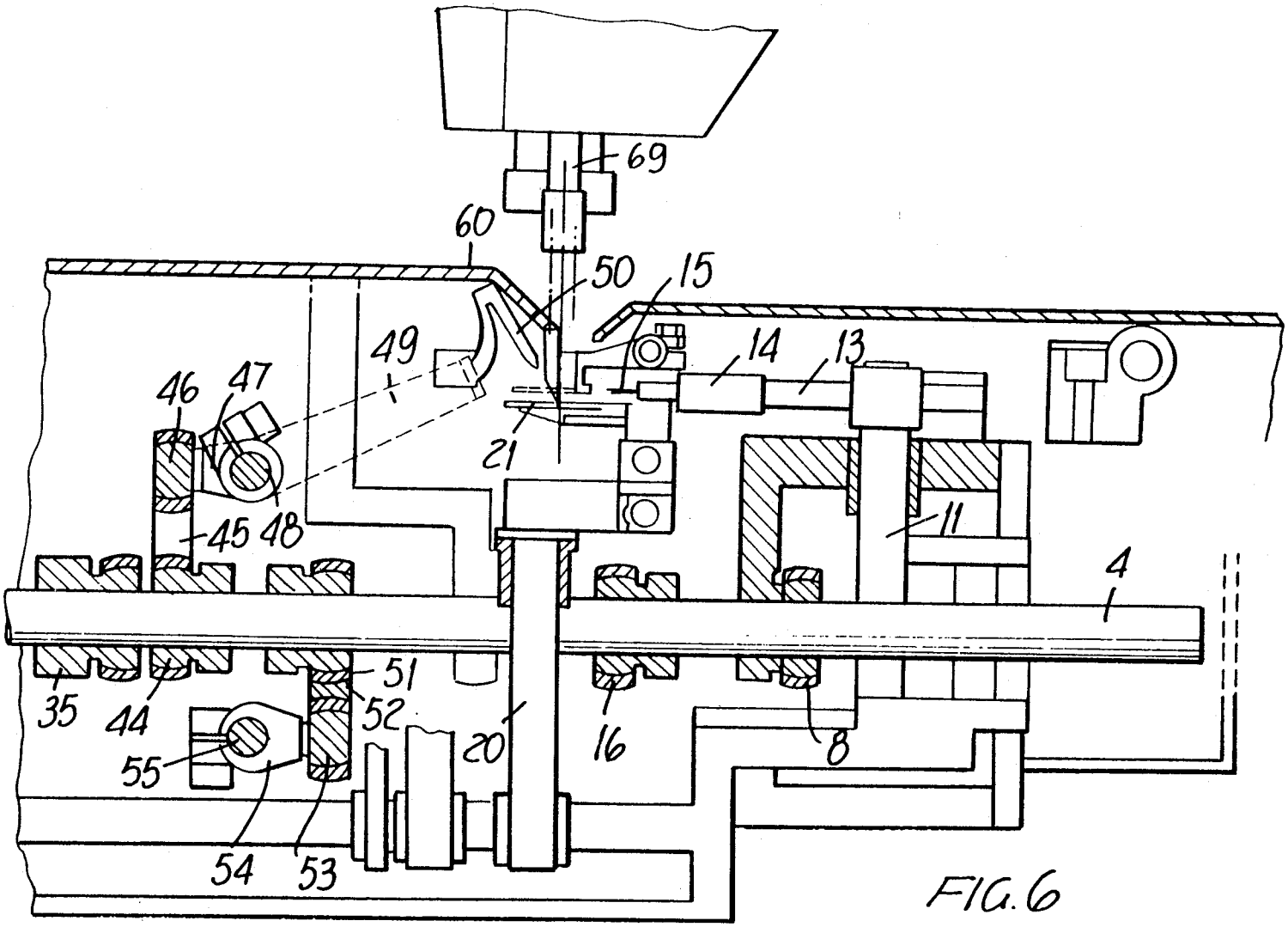
FIG. 6 is a vertical view of the sewing machine in cross-section, taken along line VI—VI of FIG. 4.
Figure 7:
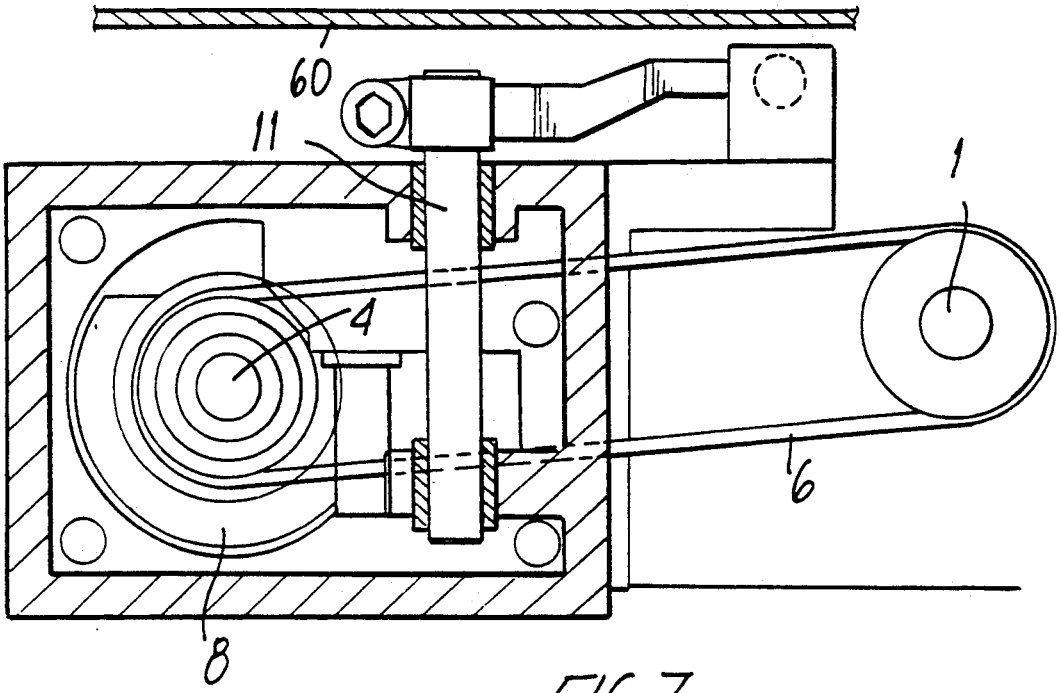
FIG. 7 is a cross-sectional view of FIG. 6.

On the first driven shaft 4, there is also provided a cam member 44 which, through a connecting rod 45 and a ball joint 46, drives a sleeve 47, as shown in FIG. 6. This sleeve, as shown, restrains a swinging pivot pin 48 on which is keyed a lever 49 bearing a hook member 50, which can perform a reciprocating movement.

Figure 8:
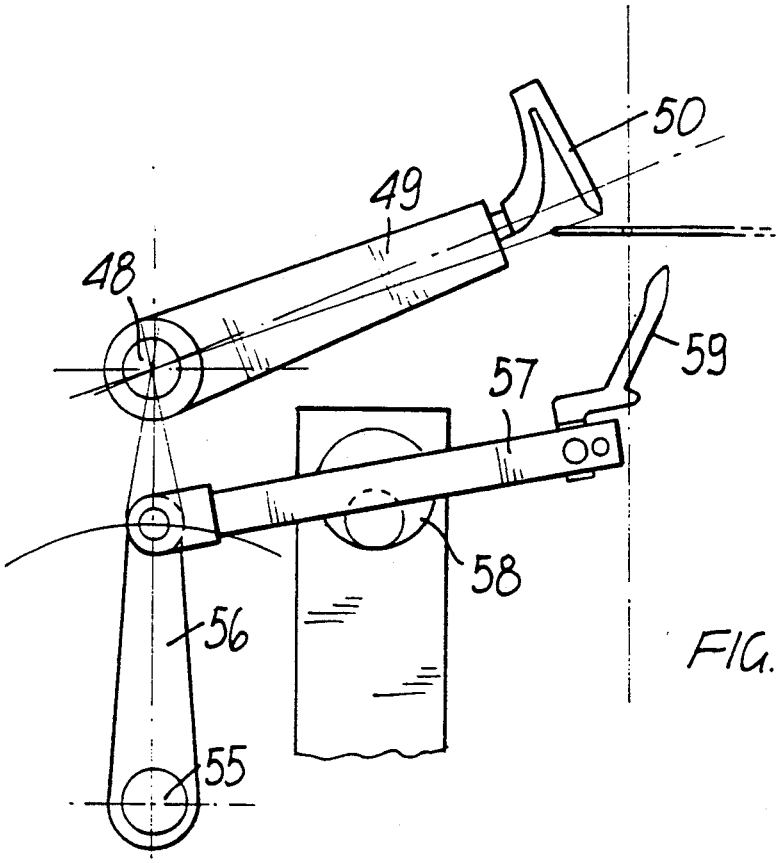
FIG. 8 shows an embodiment of the operating assembly for driving hook members cooperating with a horizontal needle operating in a horizontal direction included in the sewing machine.

On the same driven shaft 4 is also keyed another cam member 51 which, through a connecting rod 52, a ball joint 53 and a sleeve 54, swingably drives a pivot pin 55. As shown in FIG. 8, with this pivot pin is rigidly coupled a lever 56 to which is articulated an arm 57 which in turn is slidingly coupled to a swinging ball joint 58 and which supports, at its free end portion, a further vertically movable hook member 59.

Figure 4:
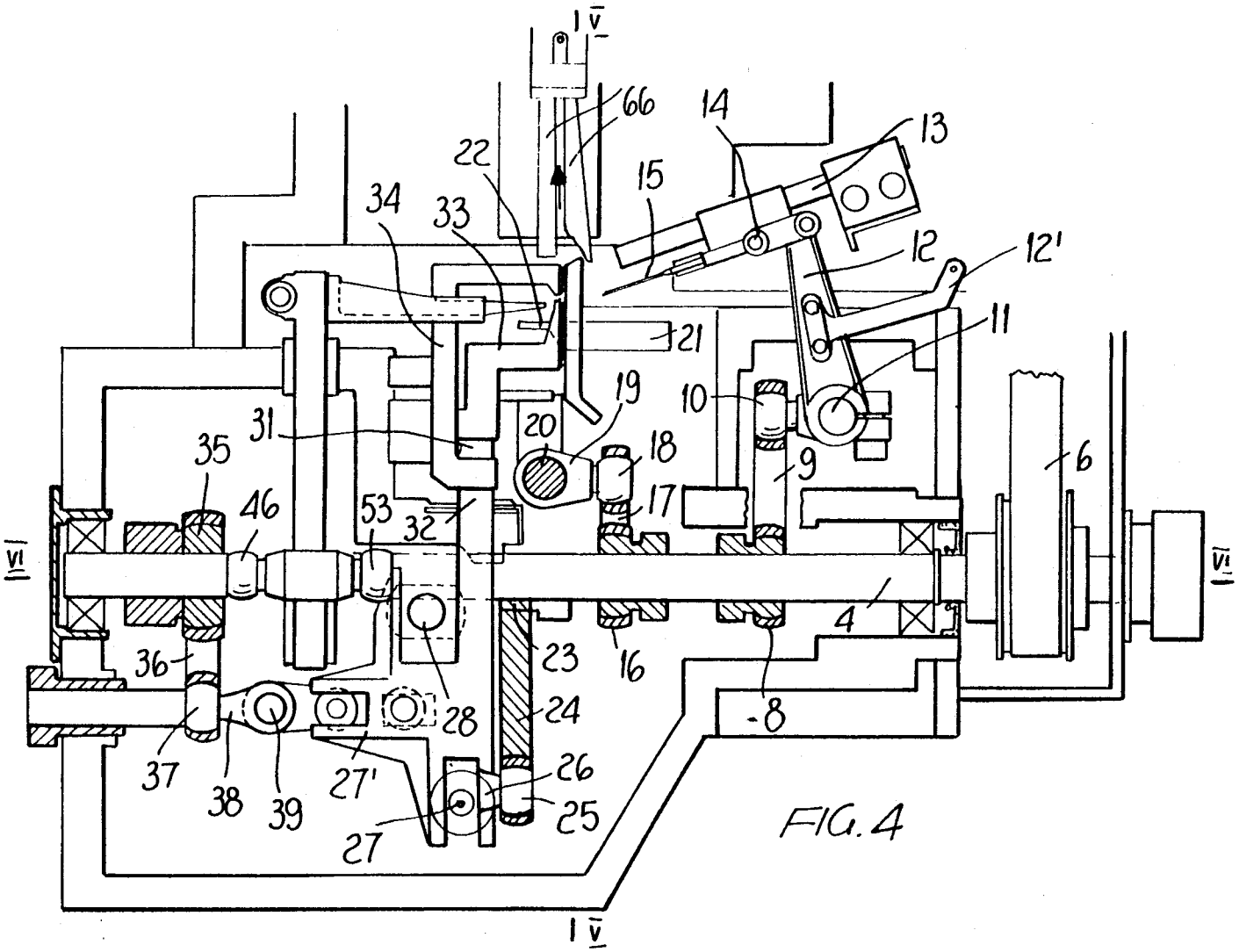
FIG. 4 is a top plan view of the sewing machine shown without its covering casing.
Figure 4A:
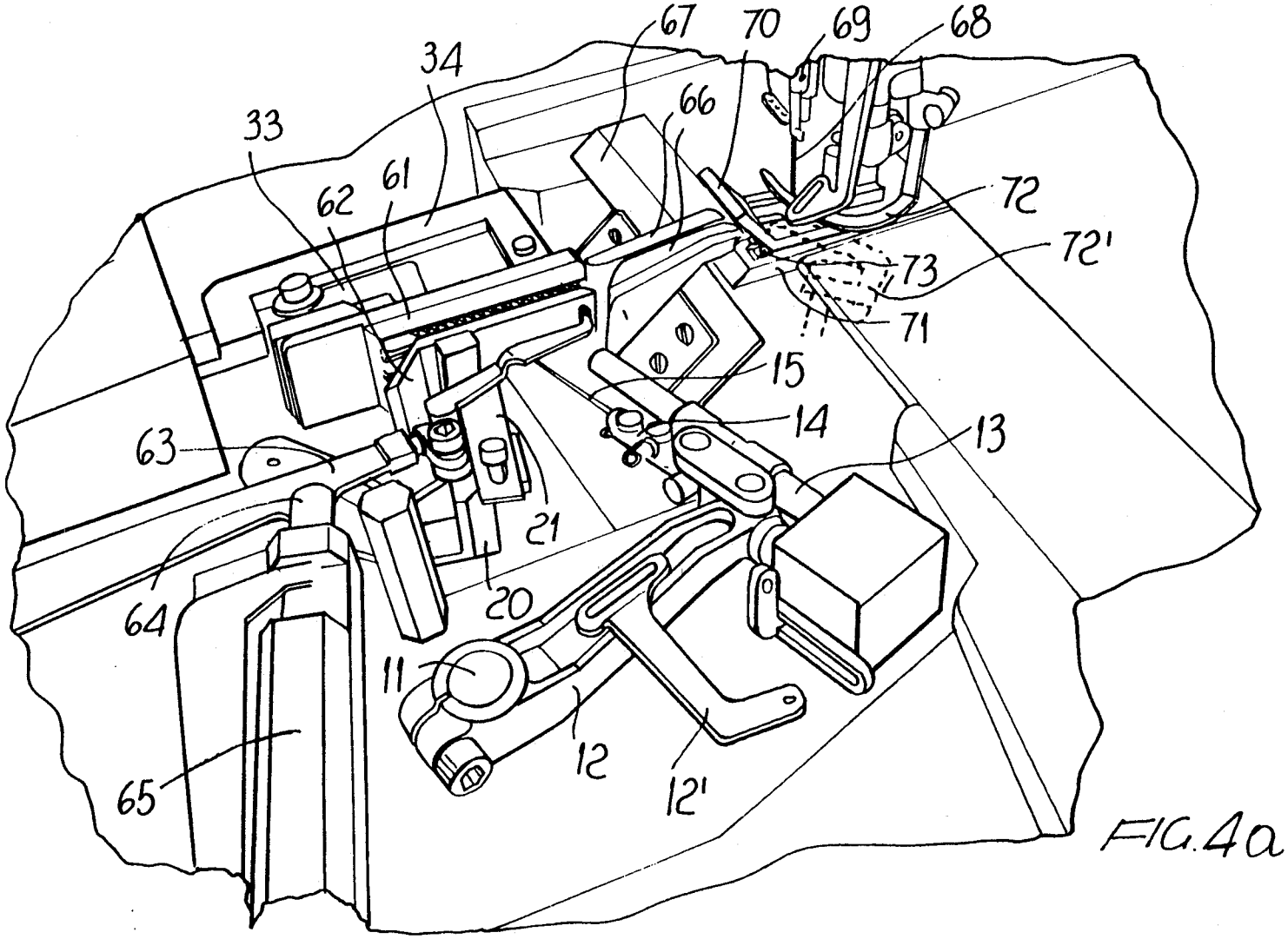
FIG. 4*a* is a partial perspective view of the sewing machine.

A needle plate 61 cooperates with the grippers 33 and 34 and a pressing small foot 62 abuts this needle plate, the foot 62 being mounted on a lever 63 pivoted to a rod 64 resiliently urged by an adjustable spring device 65, as shown in FIG. 4*a*.

Downstream of the grippers there is provided guides 66, mounted on a guide supporting element 67 and adapted to convey the two seamed fabric portions, which have been seamed or stitched by the horizontal needle 15, under a further needle 68 which is driven along a vertical axis and is adapted to perform a locking sewing operation.

Figure 2:
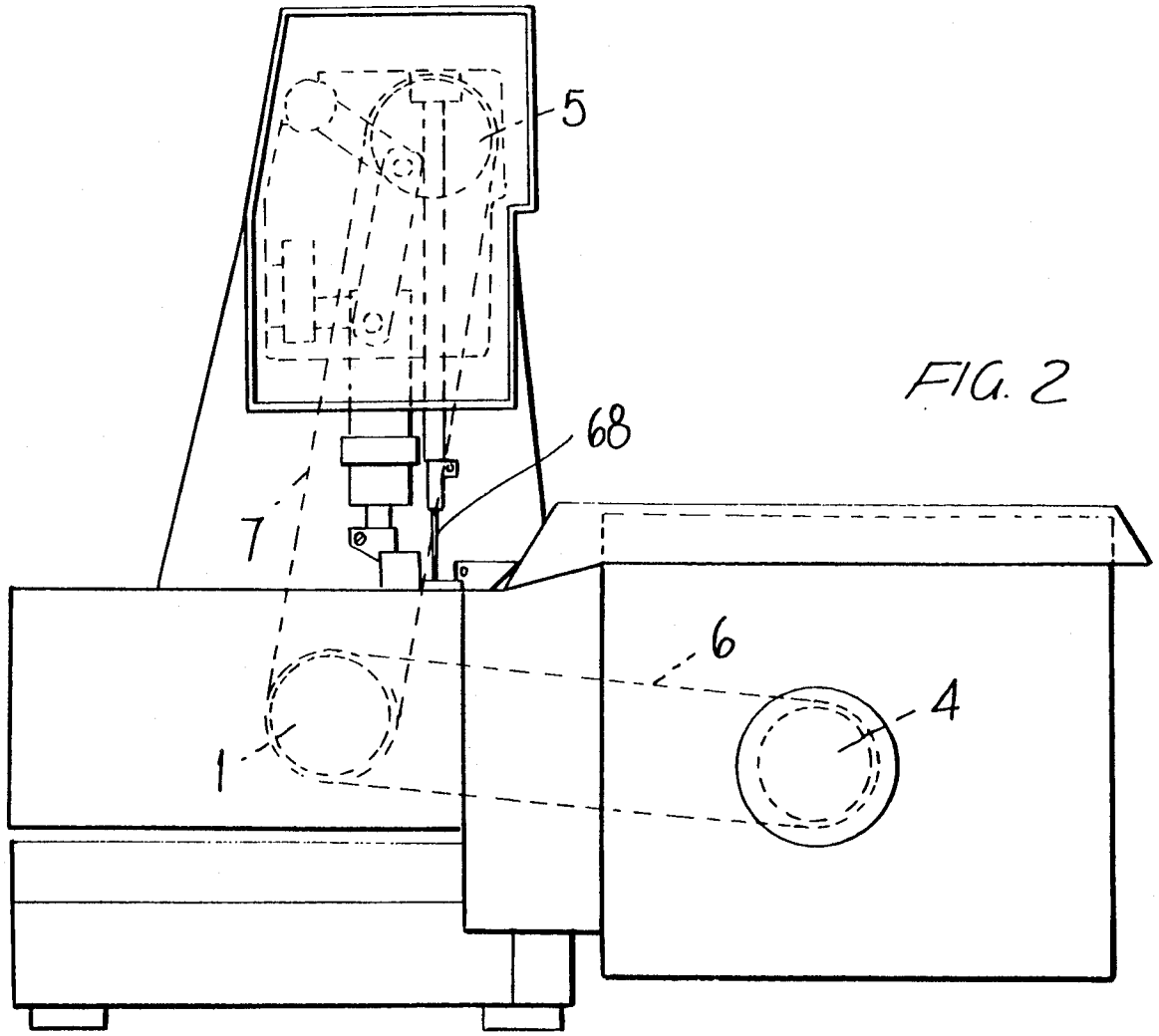
Figure 3:
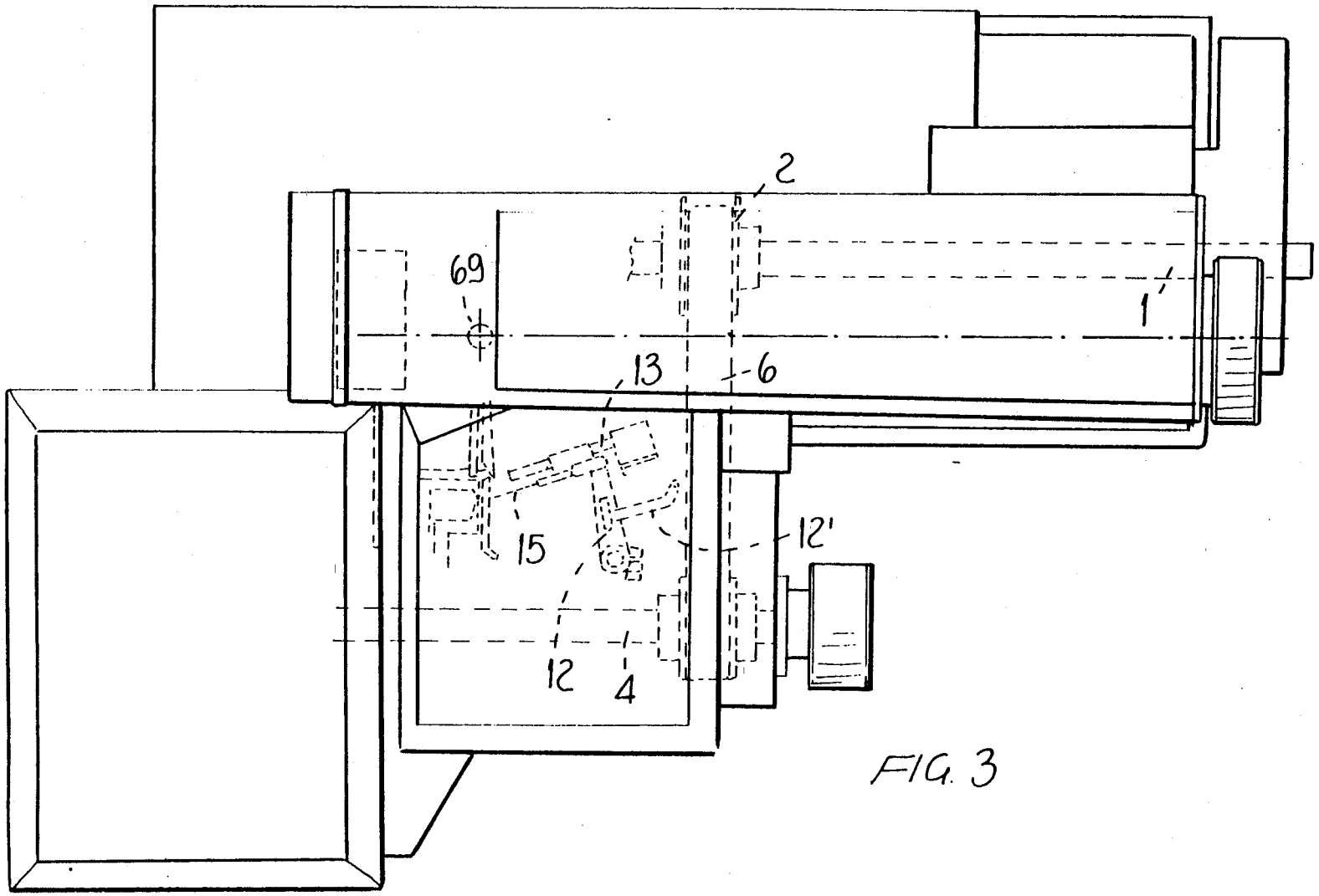

This vertical needle 68 is supported on the respective vertical needle bar 69, which is reciprocately driven by the driven shaft 5 as shown in FIG. 2 through any known driving means.

FIG. 4*a* shows that with the vertical needle 68, cooperates the foot 70, pressing on the horizontal plate 71, the hook elements 72 and 72' respectively driven by the driven shafts 5 and 1, through suitable driving means, as well as corresponding grippers 73.

There is moreover provided a suitable enclosing casing 60 which, advantageously, is also adapted to be used as a working surface. In operation, the two fabric portions to be joined are arranged on the working surface so as to arrange their corresponding edges with adjoining relationship, with a vertical descending configuration, at the level of the horizontal needle 15. More specifically, the mentioned fabric portions are arranged with the right side of the fabric upwardly directed.

In particular, FIG. 4*a* shows that the fabric is fed with its portions or flaps vertically downwardly turned, between the plate 61 and slide-foot 62, the fabric portions being joined and seamed by the needle 15 and conveyed along the guides 66 between the slide-foot 70 and plate 71 of the second portion of the seaming apparatus. The guides 66 orient the seamed fabric portions, by arranging the joined fabric portions either in the right position or in the left position, or in a vertical position for the further or second seaming step.

In this connection, it should be pointed out that a curved seaming can be performed by a horizontal needle by arranging, by lengths, the two fabric portions to be joined so as to seam the latter accordingly to short rectilinear lengths.

These short rectilinear lengths will provide a curve, in the same way in which an operator carries out a curved seam in a conventional seaming machine including a vertical needle bar.

In such a "curved" seaming operation, the needle is not displaced, but the fabric is displaced by a slight temporary deformation of the fabric itself.

This slight temporary deformation of the fabric is possible owing to the resiliency of the fabric, as on said fabric the operator exerts a manual deformation, as it should be apparent to one skilled in the art.

Obviously, the fabric can be conveyed under different angles, by causing the fabric to rotate, which can be easily achieved since the fabric is deformable, with respect to the axis of the needle.

During the seaming operation, the fabric is fed toward the vertical needle by using the grippers 73 which transport said fabric, while allowing the operator to easily drive the fabric to the desired direction, by means of conventional manual operations.

Thus, from the following disclosure it should be also apparent that, as stated, the fabric presents its portion to be seamed downwardly folded and arranged on a vertical surface as it exits the horizontal needle stage.

The fabric portions or flaps are "paired" and sent to the vertical needle, being arranged on a horizontal surface at said vertical needle.

It should also be pointed out that the timed driving of the grippers 33 and 34 will allow two or more fabric portions to be stitched to be simultaneously and timely driven, and, in particular, the fabric portions can be driven with different angles in order to perform the desired sewing operation.

Moreover, the side edges of the fabric portions entrained by the gripper, facing one another, will be trimmed at the free edge portions, by the knife 31 and then they will be further stitched by the vertical needle 68.

It should be apparent that the sewing machine according to the present invention, affords the possibility of making, in a single operating step, at a single working place and with a single operator, an assembling sewing operation on two fabric portion, followed by a stitch locking or sewing operation.

Moreover, the sewing machine according to the invention allows the fabric portions to be stitched to be arranged with a horizontal arrangement with the right side of the fabric upward turned.

Moreover, it also affords the possibility of performing two subsequent sewing operations, by orienting or spreading apart the fabric portions as desired between the two stitching operations.

What is claimed is:

1. An industrial sewing machine comprising a supporting frame supporting a main driving shaft (1) rotatively driving two rotary driven shafts (4,5), cam means supported on one of said driven shafts and driving in a horizontal plane through mechanical operating means, a horizontal needle bar (13), said cam means further driving fabric transporting grippers and hook elements the other of said driven shafts driving a vertical needle bar, said vertical needle bar being displaced in a vertical plane and arranged downstream with respect to said horizontal needle bar, said horizontal and vertical needle bars being so spaced from one another as to make two simultaneous seaming lines, said cam means including a first cam member (8), a second cam member (16), and a third cam member (23), said first cam member (8) through a first connecting rod (9) a first ball joint (10) and a first swinging pivot pin sleeve (11) operates a first lever (12) for controlling said horizontal needle bar (13), said second cam member (16) through a second connecting rod (17), a second ball joint (18), and a second swinging pivot pin (20) and sleeve (19), drives a trimming knife (21) supported on a trimming knife supporting arm (21'), said third cam member (23) through a third connecting rod (24), a third ball joint (25) and a sleeve (26), drives a first swinging pivot pin (27) which, through a second lever (27'), in turn drives a second swinging pivot pin (28), said first and second pivot pins bearing a fourth and a fifth cam member synchronously driving two gripper bearing slides (31, 32).

2. A sewing machine according to claim 1, wherein one of said slides (31) supports a gripper provided for feeding a fabric in front of one of said needles, the other of said slides (32) supports a gripper provided for transporting said fabric beyond said needle.

3. A sewing machine according to claim 1, wherein on said one of said rotary driven shafts is arranged a sixth stitch stretching cam member (35) reciprocately driving two third levers (40,41) in turn driving said gripper bearing slides (31,32) so as to cause said slides to contact said fabric and stop at a lowered position.

4. The sewing machine according to claim 3 wherein on said one of said driven shafts (4) is provided a seventh cam member (44) which through connecting rod (45) and ball joint (46) drives a sleeve (47), said sleeve restraining a swinging pivot pin (48), a fourth lever (49) being keyed on said swinging pivot pin (48), said fourth lever bearing a first hook element (50) whereby said hook element is capable of performing a swinging rotary movement.

5. A sewing machine according to claim 4, wherein on said one of said driven shafts is keyed a ninth cam element (51) driving a fifth lever (56) bearing an arm member (57) slidably coupled to a swinging ball joint (58) and bearing, at a free end thereof, a second hook element (59).

* * * * *